US007946753B2

(12) United States Patent
Kar et al.

(10) Patent No.: US 7,946,753 B2
(45) Date of Patent: May 24, 2011

(54) ROTATABLE MIXING DEVICE AND DYNAMIC MIXING METHOD

(75) Inventors: Kishore K. Kar, Midland, MI (US); Madan Somasi, Midland, MI (US); Richard F. Cope, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 12/861,095

(22) Filed: Aug. 23, 2010

(65) Prior Publication Data

US 2011/0051548 A1 Mar. 3, 2011

Related U.S. Application Data

(60) Provisional application No. 61/238,300, filed on Aug. 31, 2009.

(51) Int. Cl.
*B01F 7/24* (2006.01)

(52) U.S. Cl. ..... 366/266; 366/318; 366/330.1; 422/229

(58) Field of Classification Search ..... 366/262–263, 366/265–266, 318–324, 325.3, 330.1–330.7, 366/336–340, 325.1, 64–67, 96–98, 102–104, 366/279; 422/229
See application file for complete search history.

(56) References Cited

U.S. PATENT DOCUMENTS

| | | | | |
|---|---|---|---|---|
| 1,494,102 | A | 1/1922 | Cramer | |
| 1,696,994 | A * | 1/1929 | White | 366/266 |
| 2,577,896 | A | 12/1951 | Kinton | |
| 3,286,992 | A * | 11/1966 | Armeniades et al. | 366/339 |
| 3,291,076 | A * | 12/1966 | Flanigan et al. | 426/565 |
| 3,861,652 | A * | 1/1975 | Clark et al. | 366/336 |
| 4,068,830 | A * | 1/1978 | Gray | 366/175.2 |
| 4,199,269 | A | 4/1980 | Neumann et al. | |
| 5,302,685 | A | 4/1994 | Tsumura et al. | |
| 6,050,721 | A * | 4/2000 | Rainey | 366/321 |
| 6,146,613 | A * | 11/2000 | Anglerot et al. | 423/700 |
| 2006/0097093 | A1 | 5/2006 | Hockmeyer | |

FOREIGN PATENT DOCUMENTS

| | | | |
|---|---|---|---|
| DE | 3640052 | | 4/1988 |
| DE | 3640052 | C1 * | 4/1988 |
| EP | 0071454 | | 2/1983 |
| GB | 1122493 | | 8/1968 |
| GB | 2086249 | | 5/1982 |
| JP | 56141824 | | 11/1981 |
| JP | 59055335 | | 9/1982 |
| WO | 9214541 | | 9/1992 |
| WO | 9900180 | | 1/1999 |
| WO | 03072235 | | 9/2003 |
| WO | 2009154643 | | 12/2009 |

OTHER PUBLICATIONS

Bolzern et al., "Rapid Chemical Reactions in a Centrifugal Pump", Chemical Engineering Research and Design, 1985, vol. 63 No. 5, pp. 275-282.

Kenics Static Mixing Technology, brochure by Chemineer, Inc. 2008.

* cited by examiner

*Primary Examiner* — Charles E Cooley

(74) *Attorney, Agent, or Firm* — The Dow Chemical Company; Claude F. Purchase

(57) ABSTRACT

The present invention generally relates to a rotatable mixing device, a dynamic mixing apparatus, and a high throughput workflow system and dynamic mixing method employing the same.

14 Claims, 3 Drawing Sheets

ROTATABLE MIXING DEVICE AND DYNAMIC MIXING METHOD

CROSS-REFERENCE TO RELATED APPLICATIONS

This application claims benefit from U.S. Provisional Patent Application No. 61/238,300, filed Aug. 31, 2009, the entire contents of which are hereby incorporated herein by reference.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention generally relates to a rotatable mixing device, a dynamic mixing apparatus, and a high throughput workflow system and dynamic mixing method employing the same.

2. Description of the Related Art

Static mixing devices that comprise static mixing elements and a tube or pipe have been known for more than 40 years. Examples of such static mixing devices are mentioned in patent numbers U.S. Pat. No. 3,286,992; U.S. Pat. No. 3,861,652; U.S. Pat. No. 4,068,830; and GB 1,122,493 and patent application publication numbers GB 2,086,249 A; EP 0 071 454 A1; WO 92/14541 A1; and WO 99/00180 A1. Some of the static mixing elements are helical-shaped. Generally, the static mixing elements are immobilized within, and in physical contact with inner surfaces of, the tube or pipe. Axially flowing (e.g., pumping under pressure) two or more liquids through the tube or pipe and around the static mixing elements immobilized therein can cause temporary radial diversions of the fluids within the tube or pipe and at some point can lead to mixing of the fluids. Because such static mixing devices require axial flow of the liquids through the tube or pipe, the static mixing devices are unsuitable and ineffective for mixing two or more fluids together in a container.

Chemical and allied industries desire a rotatable mixing device and mixing method that would be capable of, among other things, mixing a viscous and non-viscous material together within a container. Preferably, a laboratory-scale version of the rotatable mixing device would be useful in a system for a high throughput mixing workflow and the mixing method comprises the high throughput mixing workflow. Such high throughput mixing workflow would be especially useful as a means for accelerating materials and formulations research and development.

BRIEF SUMMARY OF THE INVENTION

In a first embodiment, the present invention is a rotatable mixing device comprising a leading helical mixing element; a trailing helical mixing element; a number N intermediate helical mixing elements, where N is an integer of 0 or greater; and a number X means for connecting (connecting means), where X equals 1 plus N (X=1+N); the helical mixing elements having a twisted ribbon-shape and the same direction of twist (i.e., handedness); the rotatable mixing device being configured in such a way that the leading, intermediate, and trailing helical mixing elements are axially aligned with and in sequential operative connection to each other, each operative connection between adjacent helical mixing elements independently comprising one of the connecting means. Each helical mixing element independently is characterizable as having spaced-apart leading and trailing edges; a longitudinal axis; a length ($L_e$) along its longitudinal axis; an angle of twist ($T_e$) of from 90 degrees (°) to 360° about its longitudinal axis; a diameter ($D_e$) perpendicular to its longitudinal axis; and being dimensioned so as to establish a configuration of the helical mixing element characterizable by a mathematical relationship between each $L_e$ and $D_e$ of $D_e \leqq L_e \leqq 2D_e$. Adjacent helical mixing elements and the connecting means through which they are connected are configured in such a way so as to dispose the leading edge of one of the adjacent helical mixing elements within a separation distance ($S_a$) of and at an offset angle ($\alpha_a$) to the trailing edge of the other of the adjacent helical mixing elements so as to independently establish relative spacing and orientation between the adjacent helical mixing elements characterizable by a mathematical relationship between $S_a$ and each of their $L_e$ of $0L_e \leqq S_a \leqq L_e$ and a value for $\alpha_a$ of from 0° to 90°, respectively.

In a second embodiment, the present invention is a dynamic mixing apparatus comprising the rotatable mixing device of the first embodiment and a container; the container having top and bottom portions and a wall portion, the top portion defining an aperture, the wall portion being disposed between the top and bottom portions so as to space apart the top and bottom portions and define an enclosed volumetric space within the container, the container having a longitudinal axis between the aperture of the top portion and the bottom portion; at least the helical mixing elements of the rotatable mixing device being disposed within the enclosed volumetric space of the container.

In a third embodiment, the present invention is a high throughput workflow system comprising at least two dynamic mixing apparatuses of the second embodiment.

In a fourth embodiment, the present invention is a dynamic mixing method of mixing together two or more flowable materials, the two or more flowable materials being disposed in the enclosed volumetric space of the container of the dynamic mixing apparatus of the second embodiment, the two or more flowable materials being in a form of an incompletely mixed composition thereof, the incompletely mixed composition comprising a total volume that is less than the enclosed volumetric space of the container and sufficient so as to at least mostly submerge (i.e., submerge at least 55 percent of length, as measured by $L_e$) at least the leading one of the helical mixing elements of the rotatable mixing device, the method comprising independently rotating the rotatable mixing device of the dynamic mixing apparatus at a sufficient speed (e.g., a sufficient number of revolutions per minute) and in a direction appropriate for the handedness of the helical mixing elements (i.e., either clockwise or counterclockwise direction) so as to establish a simultaneous downward-directed flow of the two or more flowable materials adjacent the rotatable mixing device and an upward-directed flow of the two or more flowable materials spaced apart from the rotatable mixing device and adjacent the downward-directed flow, the downward-directed and upward-directed flows being essentially parallel (e.g., parallel and antiparallel) to the longitudinal axes of the rotatable mixing device and container, thereby mixing the two or more flowable materials together to give an approximately uniform mixture thereof.

The rotatable mixing device of the first embodiment, dynamic mixing apparatus of the second embodiment, and system of the third embodiment are independently useful in the method of the fourth embodiment. In the method of the fourth embodiment employing the high throughput workflow system of the third embodiment, each container independently holds two or more flowable materials. The present invention is useful in any procedure, process, or method that could benefit from dynamic mixing. Such procedure, process, or method includes viscous fluid settings such as construction (e.g., mixing concrete or coatings, for example, paint in containers, for example 19 liter (L) buckets), industrial-scale manufacturing, pilot plant-scale development, and laboratory-scale research settings. The present invention is especially useful for mixing two or more flowable materials together, where at least one of the flowable materials is a flowable particulate solid (e.g., a solid pigment, for example, titanium dioxide pigment) or a liquid characterizable as being a medium or high viscosity liquid.

The present invention is especially useful in applications for preparing, for example, viscous construction materials or formulation samples such as flowable liquid-liquid formulations, particulate solid dispersions in a liquid, colloids, solutions of solutes dissolved in solvents characterized by a concentration gradient of solutes therein, microgels, and dispersions or solutions of a gas in a liquid. The system of the third embodiment is particularly useful in a high throughput mixing workflow. Such high throughput mixing workflow is especially useful as a means for accelerating materials and formulations research and development in, for example, the combinatorial chemistry, in vitro biological assay, coating (e.g., paint), cleaner formulation, polymer latex, and polymer-microfiller and -nanofiller composite arts.

Additional embodiments are described in accompanying drawing(s) and the remainder of the specification, including the claims.

BRIEF DESCRIPTION OF THE DRAWING(S)

Some embodiments of the present invention are described herein in relation to the accompanying drawing(s), which will at least assist in illustrating various features of the embodiments.

FIG. 1A (FIG. 1A) and FIG. 1B show a couple of examples of preferred embodiments of the rotatable mixing device.

DETAILED DESCRIPTION OF THE INVENTION

Figure 1A:
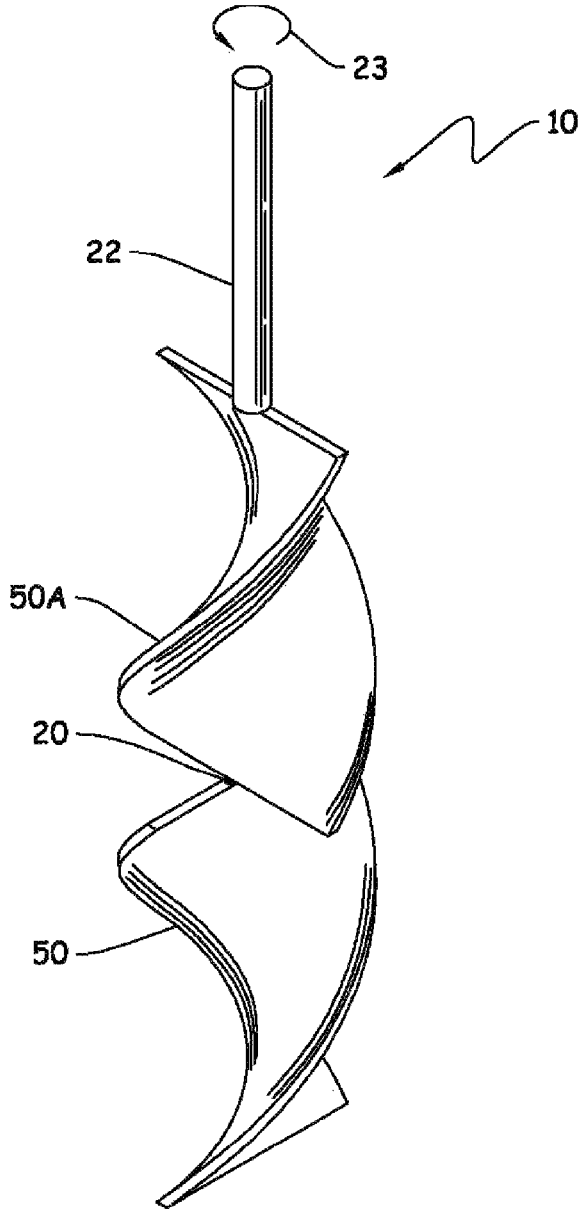
Figure 1B:
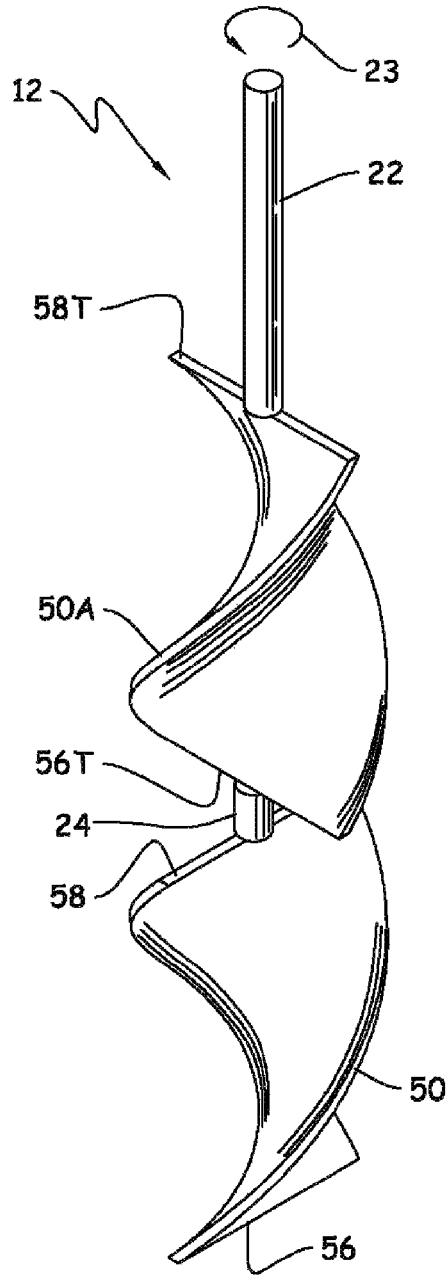

FIG. 1A (FIG. 1A) and FIG. 1B show a couple of examples of preferred embodiments of the rotatable mixing device where the rotatable mixing device is disposed in a preferred vertical orientation such that a trailing helical mixing element (50A) is disposed above a leading helical mixing element (50). The invention contemplates other orientations (not illustrated) such as horizontal orientations and an inverse of the aforementioned vertical orientation of the rotatable mixing device, the rotatable mixing device being bottom mounted.

Figure 3:
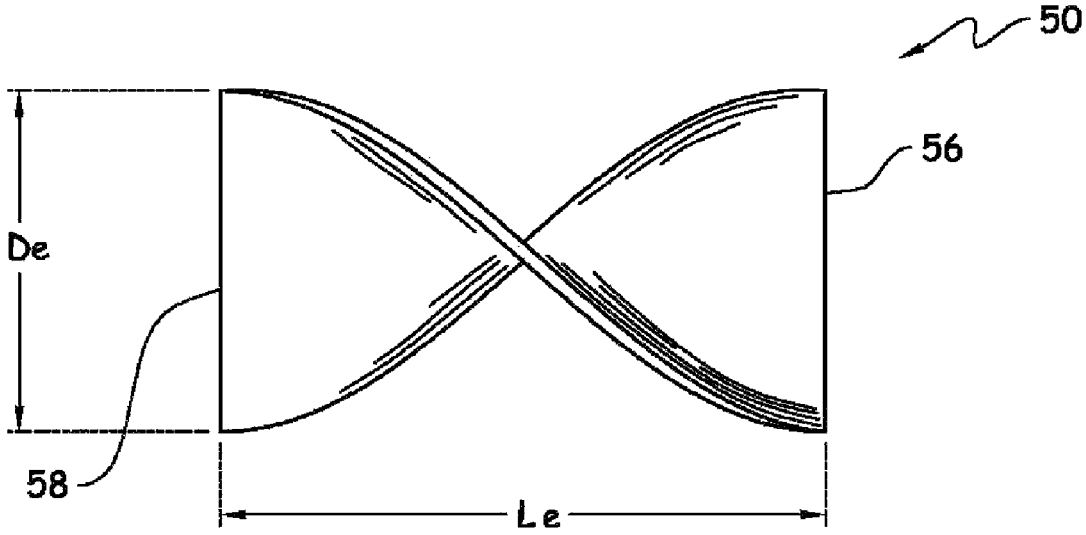
FIG. 3 shows an example of a preferred embodiment of the helical mixing element.

In the preferred embodiments of the rotatable mixing device shown in FIGS. 1A and 1B, respectively $S_a=0L_e$ (i.e., $S_a=0$) or $S_a>0L_e$. FIG. 1A shows rotatable mixing device 10 with preferred counterclockwise direction of rotation indicated by arrow 23. In FIG. 1A, rotatable mixing device 10 comprises leading helical mixing element 50, trailing helical mixing element 50A, connecting means 20, and drivable cylindrical shaft 22 (partially cut away). As shown later in FIG. 3, each of leading and trailing helical mixing elements 50 and 50A have a diameter $D_e$ and length $L_e$, where in FIG. 1A $D_e<L_e$. Each of leading and trailing helical mixing elements 50 and 50A have a 180° angle of twist ($T_e=180°$) are operatively connected to each other by connecting means 20 (e.g., a weld), and are configured and dimensioned as shown in FIG. 3. Drivable cylindrical shaft 22 (partially cut away) is an example of a drivable connecting element (described later) and is operatively connected to trailing helical mixing element 50A via a weld (not indicated). Assemble rotatable mixing device 10 by welding together leading and trailing helical mixing elements 50 and 50A, and then weld drivable cylindrical shaft 22 to trailing helical mixing element 50A, thereby assembling rotatable mixing device 10.

FIG. 1B shows rotatable mixing device 12 with preferred counterclockwise direction of rotation indicated by arrow 23. In FIG. 1B, rotatable mixing device 12 comprises leading and trailing helical mixing elements 50 and 50A (same as in FIG. 1A), connecting shaft 24, and drivable cylindrical shaft 22 (partially cut away, same as in FIG. 1A). Leading helical mixing element 50 defines a leading edge 56 and a trailing edge 58 and trailing helical mixing element 50A defines a leading edge 56T and a trailing edge 58T. Trailing edge 58 of leading helical mixing element 50 is spaced apart by distance $S_a$ from leading edge 56T of trailing helical mixing element 50A by connecting shaft 24 and are in operative connection thereto. Each of leading and trailing helical mixing elements 50 and 50A have a 180° angle of twist ($T_e=180°$) and are configured and dimensioned as shown in FIG. 3. Drivable cylindrical shaft 22 (partially cut away) is an example of a drivable connecting element and is operatively connected to trailing edge 58T of trailing helical mixing element 50A via a weld (not indicated). Assemble rotatable mixing device 12 by welding together leading helical mixing element 50 and an end (not indicated) of connecting shaft 24, then weld the other end (not indicated) of connecting shaft 24 to trailing helical mixing element 50A, and then weld drivable cylindrical shaft 22 to trailing helical mixing element 50A, thereby assembling rotatable mixing device 12.

Where the rotatable mixing devices 10 and 12 are dimensioned for use in the high throughput workflow system of the third embodiment, preferably each $L_e$ is 17 millimeters (mm); $D_e$ is 11 mm; and drivable cylindrical shaft 22 has a length of about 27 mm. More preferably, a shallow channel (not shown) circumscribes drivable cylindrical shaft 22 about 3 mm from unattached ends thereof (not indicated in FIGS. 1A and 1B). Also more preferably, drivable cylindrical shaft 22 also has two 3 mm long by 1 mm wide flanges disposed on opposite sides thereof at about 10 mm from the unattached ends thereof.

Figure 2:
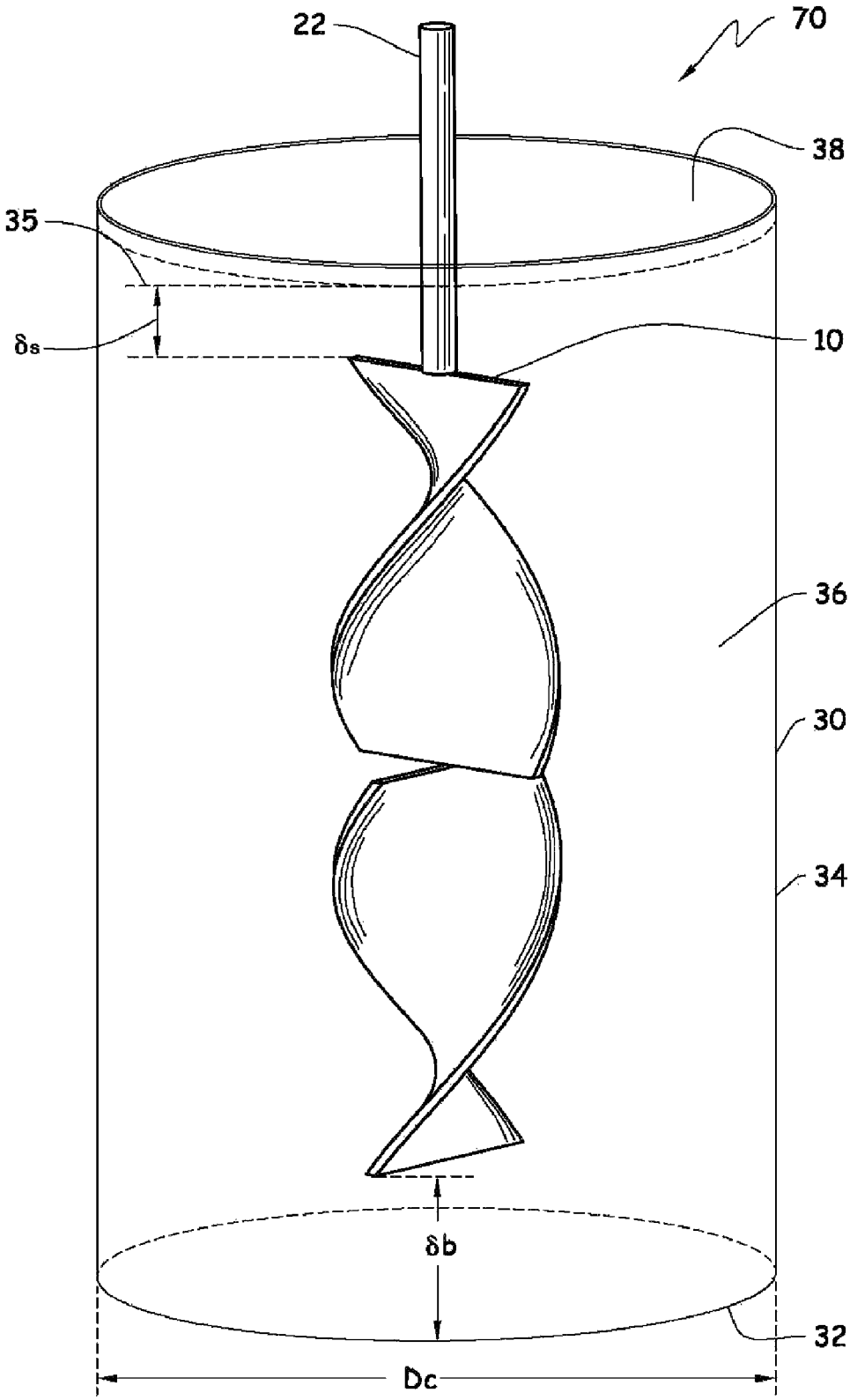
FIG. 2 shows an example of a preferred embodiment of the dynamic mixing apparatus.

FIG. 2 shows an example of a preferred embodiment of the dynamic mixing apparatus 70 comprising the rotatable mixing device 10 of FIG. 1A and container 30. In FIG. 2, container 30 has bottom portion 32 and wall portion 34, enclosed volumetric space 36, aperture 38, a hypothetical fill line 35, and an inner diameter $D_e$ (described later). Rotatable mixing device 10 is disposed in enclosed volumetric space 36 of container 30 so as to be spaced apart from bottom portion 32 of container 30 by distance $\delta_b$ (described later) and is spaced apart from wall portion 34 of container 30. Trailing helical mixing element 50A of rotatable mixing device 10 is spaced apart from hypothetical fill line 35 by distance $\delta_s$ (described later). Diameter $D_e$ of helical mixing element 10 is approximately one half of inner diameter $D_e$ of container 30 (i.e., $D_e=0.5D_e$); $\delta_b<L_e$; and $\delta_s<L_e$. Assemble dynamic mixing apparatus 70 by disposing rotatable mixing device 10 in enclosed volumetric space 36 of container 30 as described previously and operatively connect drivable cylindrical shaft 22 of rotatable mixing device 10 to a means for rotating (not shown, described later), which also preferably functions so as to hold rotatable mixing device 10 within enclosed volumetric space 36 of container 30 as described. Perform a dynamic mixing method of the fourth embodiment employing dynamic mixing apparatus 70 by adding two flowable materials (not shown) into enclosed volumetric space 36 of container 30 of dynamic mixing apparatus 70 to form an incompletely mixed composition thereof (not shown) that fills container 30 to hypothetical fill line 35. Activate the means for rotating (e.g., a stirrer motor, not shown) so as to rotate rotatable mixing device 10 within the incompletely mixed composition thereof (not shown) at an appropriate speed and in an appropriate direction (i.e., counterclockwise as shown by arrow 23 in FIGS. 1A and 1B), thereby establishing a simultaneous downward-directed flow (not shown) of the two or more flowable materials (not shown) adjacent the rotatable mixing device 10 and an upward-directed flow (not shown) of the two or more flowable materials (not shown) spaced apart from the rotatable mixing device 10 and adjacent the downward-directed flow (not shown), the downward-directed and upward-directed flows (not shown) being essentially parallel (e.g., parallel and antiparallel) to the longitudinal axes (not shown, i.e., vertical axes) of the rotatable mixing device 10 and container 30, thereby mixing the two or more flowable materials (not shown) together to give an approximately uniform mixture thereof (not shown). In such an embodiment of the method, the upward-directed flow of the two or more flowable materials (not shown) is also adjacent wall portion 34 of container 30.

FIG. 3 shows an example of a preferred embodiment of the helical mixing elements 50 and 50A having a preferred 180 degree angle of twist ($T_e$=180°), a diameter $D_e$, and length $L_e$. Such helical mixing elements can be obtained or adapted from a commercial source such as, for example, a Kenics® KM series static mixer sold by Chemineer Inc., Dayton, Ohio, USA (Chemineer, Inc. is a subsidiary of Robbins & Myers, Inc.).

Figure 4:
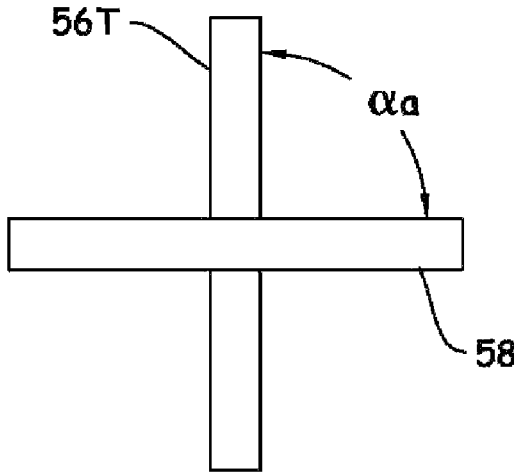
FIG. 4 shows a preferred orientation of a trailing edge of a leading helical mixing element and a leading edge of a trailing helical mixing element of the rotatable mixing device.

FIG. 4 shows a preferred orientation (as if looking from bottom up in FIG. 1B) of trailing edge 58 of leading helical mixing element 50 and leading edge 56T of trailing helical mixing element 50A of rotatable mixing device 12 (see FIG. 1B), trailing edge 58 being oriented at a preferred 90° offset angle (i.e., $\alpha_a$=90°) relative to leading edge 56T.

For purposes of United States patent practice and other patent practices allowing incorporation of subject matter by reference, the entire contents—unless otherwise indicated—of each U.S. patent, U.S. patent application, U.S. patent application publication, PCT international patent application and WO publication equivalent thereof, referenced in the instant Summary or Detailed Description of the Invention are hereby incorporated by reference. In an event where there is a conflict between what is written in the present specification and what is written in a patent, patent application, or patent application publication, or a portion thereof that is incorporated by reference, what is written in the present specification controls.

In the present application, any lower limit of a range of numbers, or any preferred lower limit of the range, may be combined with any upper limit of the range, or any preferred upper limit of the range, to define a preferred aspect or embodiment of the range. Each range of numbers includes all numbers, both rational and irrational numbers, subsumed within that range (e.g., the range from about 1 to about 5 includes, for example, 1, 1.5, 2, 2.75, 3, 3.80, 4, and 5).

In an event where there is a conflict between a unit value that is recited without parentheses, e.g., 2 inches, and a corresponding unit value that is parenthetically recited, e.g., (5 centimeters), the unit value recited without parentheses controls.

As used herein, "a," "an," "the," "at least one," and "one or more" are used interchangeably. In any aspect or embodiment of the instant invention described herein, the term "about" in a phrase referring to a numerical value may be deleted from the phrase to give another aspect or embodiment of the instant invention. In the former aspects or embodiments employing the term "about," meaning of "about" can be construed from context of its use. Preferably "about" means from 90 percent to 100 percent of the numerical value, from 100 percent to 110 percent of the numerical value, or from 90 percent to 110 percent of the numerical value. In any aspect or embodiment of the instant invention described herein, the open-ended terms "comprising," "comprises," and the like (which are synonymous with "including," "having," and "characterized by") may be replaced by the respective partially closed phrases "consisting essentially of," consists essentially of," and the like or the respective closed phrases "consisting of," "consists of," and the like to give another aspect or embodiment of the instant invention. In the present application, when referring to a preceding list of elements (e.g., ingredients), the phrases "mixture thereof," "combination thereof," and the like mean any two or more, including all, of the listed elements. The term "or" used in a listing of members, unless stated otherwise, refers to the listed members individually as well as in any combination, and supports additional embodiments reciting any one of the individual members (e.g., in an embodiment reciting the phrase "10 percent or more," the "or" supports another embodiment reciting "10 percent" and still another embodiment reciting "more than 10 percent."). The term "plurality" means two or more, wherein each plurality is independently selected unless indicated otherwise. The symbols "≦" and "≧" respectively mean less than or equal to and greater than or equal to. The symbols "<" and ">" respectively mean less than and greater than.

Preferably, $T_e$ is from 120° to 270° and more preferably $T_e$ is about 180°.

Preferably, $1.2D_e \leqq L_e \leqq 1.8D_e$ (e.g., $L_e=1.25D_e$ or $1.75D_e$), more preferably $1.3D_e \leqq L_e \leqq 1.7D_e$ (e.g., $L_e=1.35\ D_e$ or $1.65\ D_e$), still more $1.4D_e \leqq L_e \leqq 1.6D_e$ (e.g., $L_e=1.45D_e$ or $1.55D_e$), and even more preferably $L_e$ is about $1.5D_e$ (e.g., $L_e=1.5D_e$). Also preferably, $L_e$ for each helical mixing element (e.g., 50 and 50A) is the same and $D_e$ for each helical mixing element (e.g., 50 and 50A) is the same.

Each operative connection between adjacent helical mixing elements (e.g., 50 and 50A) comprises direct physical connection when $S_a$ is 0 or indirect physical connection when $S_a$ is greater than 0 (i.e., the mathematical relationship between $S_a$ and their $L_e$ becomes $0L_e<S_a \leqq L_e$), each connecting means comprising the indirect physical connection independently comprising a connecting element, the connecting element being in operative connection with the adjacent helical mixing elements.

In some embodiments, $S_a$ is about $0L_e$, and more preferably $S_a$ equals $0L_e$ (i.e., $S_a$ is 0). In such embodiments, the connecting means (e.g., 20) comprises or is derived from the adjacent helical mixing elements (e.g., 50 and 50A) being connected together thereby. Examples of such connecting means are a weld or the trailing edge of one of the adjacent helical mixing elements and the leading edge of the other of the adjacent mixing elements each define a notch, the notches being complimentary to each other so as to establish a friction fit between the adjacent helical mixing elements.

In some embodiments, $S_a \leqq 0.9L_e$, more preferably $S_a \leqq 0.7L_e$, still more preferably $S_a \leqq 0.6L_e$, and even more preferably $S_a \leqq 0.5L_e$. In such embodiments, the connecting means comprises a connecting element (e.g., 24), the connecting element having a portion being in operative connection to the trailing edge of one of the adjacent helical mixing elements (e.g., 50 and 50A) and a portion being in operative connection to the leading edge of the other of the adjacent helical mixing elements being connected together thereby. Examples of such connecting elements are a shaft, adhesive, and female-female bracket. Preferred is the shaft.

In some embodiments, $\alpha_a > 0°$, more preferably $\alpha_a > 30°$, still more preferably $\alpha_a > 45°$, even more preferably $\alpha_a > 60°$, and yet more preferably, $75° \leqq \alpha_a \leqq 90°$ (e.g., $\alpha_a$ is about 90°).

In some embodiments of the dynamic mixing apparatus (e.g., 70) of the second embodiment, at least two, preferably all, of the helical mixing elements (e.g., 50 and 50A) of the rotatable mixing device (e.g., 10) are disposed within the enclosed volumetric space (e.g., 36) of the container (e.g., 30) in such a way that the rotatable mixing device and the container are approximately axially aligned (i.e., approximately parallel, preferably vertical axially aligned) with each other and the leading edge (e.g., 56) of the leading helical mixing element (e.g., 50) is spaced-apart from the bottom portion (e.g., 32) of the container (e.g., 30) by a distance ($\delta_b$) so as to establish a mathematical relationship between $\delta_b$ and $L_e$ of the leading helical mixing element of $0L_e < \delta_h \leqq L_e$. In some embodiments, $\delta_b$ is $>0L_e$ (e.g., $\delta_b$ is $0.1L_e$). In some embodiments, $\delta_b \leqq 0.9L_e$, more preferably $\delta_b \leqq 0.7L_e$, still more preferably $\delta_b \leqq 0.6L_e$, and even more preferably $\delta_b \leqq 0.5L_e$ (e.g., $\delta_b$ is $0.5L_e$). In some embodiments, $\delta_b \geqq 0.2L_e$, more preferably $\delta_b \geqq 0.3L_e$, still more preferably $\delta_b \geqq 0.4L_e$, and even more preferably $\delta_b > 0.5L_e$ (e.g., $\delta_b$ is $0.55L_e$).

In the dynamic mixing method of the fourth embodiment, preferably all of the leading helical mixing element is, more preferably all of the leading helical mixing element and all of at least a next helical mixing element (e.g., an intermediate helical mixing element where present or the trailing helical mixing element where no intermediate helical mixing element is present) is, and still more preferably all of the helical mixing elements are completely submerged in the incompletely mixed composition. When all of the helical mixing elements (e.g., 50 and 50A) are completely submerged in the incompletely mixed composition, preferably the incompletely mixed composition has a top surface (e.g., at hypothetical fill line 35 in FIG. 2), the top surface of the incompletely mixed composition being approximately at or spaced-apart from the trailing edge (e.g., 58T) of the completely submerged trailing helical mixing element (e.g., 50A) by a distance ($\delta_s$) so as to establish a mathematical relationship between $\delta_s$ and $L_e$ of the trailing helical mixing element of $0L_{et} \leqq \delta_s \leqq L_{et}$, where $L_{et}$ is the length $L_e$ of the trailing helical mixing element. In some embodiments, $\delta_s$ is $>0L_{et}$ (e.g., $\delta_s$ is $0.1L_{et}$). In some embodiments, $\delta_s \leqq 0.9L_{et}$, and more preferably $\delta_s$ is $0.5L_{et}$.

In the dynamic mixing method of the fourth embodiment, preferably the container (e.g., 30) is characterizable as having a width or, more preferably, an inner diameter ($D_c$) perpendicular to its longitudinal axis (not indicated) and within the enclosed volumetric space (e.g., 36) of the container (e.g., 30). In embodiments of the method of the fourth embodiment where the longitudinal axis of the rotatable mixing device is being moved relative to the longitudinal axis of the container, more preferably the dynamic mixing apparatus is dimensioned in such a way so as to establish a mathematical relationship between $D_c$ and each $D_e$ of $0.10D_c \leqq D_e \leqq 0.70D_c$. Such relative movement can be achieved by maintaining the rotatable mixing device (e.g., 10) in a fixed position and moving the container (e.g., 30, such as by using an orbital mixer) or by maintaining the container (e.g., 30) in a fixed position and moving the rotatable mixing device (e.g., 10, such as by moving a movable stirrer motor such as a hand-held stirrer motor).

In embodiments of the dynamic mixing method of the fourth embodiment where the longitudinal axis (not indicated) of the rotatable mixing device (e.g., 10 and 12) is essentially maintained in a stationary position relative to the longitudinal axis (not indicated) of the container (e.g., 30, i.e., rotatable mixing device essentially is not moving around in the container other than being rotated therein), preferably the upward-directed flow of the two or more flowable materials is adjacent the wall portion (e.g., 34) of the container (e.g., 30) and the dynamic mixing apparatus (e.g., 70) is dimensioned in such a way so as to establish a mathematical relationship between $D_e$ and each $D_e$ of $0.30D_c \leqq D_e \leqq 0.70D_c$. In such embodiments, more preferably $0.33D_c \leqq D_e \leqq 0.67D_c$, still more preferably $0.40D_c \leqq D_e \leqq 0.60D_c$, and even more preferably $0.45D_c \leqq D_e \leqq 0.55D_c$ (e.g., $0.5D_c = D_e$). Such embodiments are preferred for use in the high throughput workflow system of the third embodiment.

In some embodiments of the dynamic mixing method of the fourth embodiment, the method employs two or more dynamic mixing apparatuses of the second embodiment in series or, more preferably, in parallel (e.g., in a high throughput workflow system of the third embodiment). Where two or more dynamic mixing apparatuses are employed, the two or more dynamic mixing apparatuses (and thus their respective rotatable mixing devices) are independently employed such that their respective characteristics may be the same or different. For example, rotation characteristics, such as direction (e.g., clockwise or counterclockwise), speed, and time of rotation, of each of the two or more rotatable mixing devices of the two or more dynamic mixing apparatuses may be the same or different.

In some embodiments, the rotatable mixing device (e.g., 10 and 12) does not contain an intermediate helical mixing element, i.e., N is 0. In some embodiments, the rotatable mixing device (e.g., 10 and 12) further comprises one or more intermediate helical mixing elements (e.g., not shown but would be as, e.g., 50), i.e., N is an integer of 1 or greater. Preferably, there are three or fewer intermediate helical mixing elements (i.e., N is 0, 1, 2, or 3), more preferably two (i.e., N is 2), still more preferably one (i.e., N is 1), and even more preferably no (i.e., N is 0) intermediate helical mixing elements.

In some embodiments, the rotatable mixing device (e.g., 10 and 12) further comprises a drivable connecting element (e.g., 22), the drivable connecting element (e.g., 22) being in operative connection to the trailing edge (e.g., 58T) of the trailing one of the helical mixing elements (e.g., 50A). Preferably the drivable connecting element comprises a shaft (e.g., 22) and is capable of operatively connecting to a means for rotating (e.g., not shown), the means for rotating being capable of rotating the rotatable mixing device (e.g., 10 and 12) around its longitudinal axis (not indicated) in a dynamic mixing method of the fourth embodiment. Preferably, the means for rotating is a stirrer motor (e.g., electricity powered or compressed-air driven stirrer motor).

The present invention method provides an approximately uniform mixture of the two or more flowable materials. The term "approximately uniform mixture" means a composition of two or more materials, the composition being at least 85 percent (%) mixed, preferably at least 95% mixed, more preferably at least 99% mixed, as determined by digital image processing measurements (see Example 1 later).

The dynamic mixing method of the fourth embodiment is characterizable by rapid mixing of the two or more flowable materials to give the approximately homogeneous mixture thereof, preferably in less than 10 minutes, more preferably in less than 5 minutes, still more preferably in less than 3 minutes, and even more preferably less than 2 minutes. The rapid mixing is especially where the upward-directed flow (not shown) of the two or more flowable materials (not shown) is adjacent the wall portion (e.g., 34) of the container (e.g., 30) and the dynamic mixing apparatus (e.g., 10 and 12) is dimensioned in such a way so as to establish a mathematical relationship between $D_c$ and each $D_e$ of $0.30D_c \leqq D_e \leqq 0.70D_c$ even when one of the flowable materials is characterizable as having a medium or high viscosity at 20 degrees Celsius (° C.) and another one of the flowable materials is characterizable as having a low viscosity at 20° C.

The invention contemplates employing containers (e.g., 30) for holding the flowable materials. Any containers suitable for mixing can be used, although especially in methods of the fourth embodiment where the longitudinal axis (not indicated) of the rotatable mixing device (e.g., 10 and 12) is essentially not moved relative to the longitudinal axis (not indicated) of the container, preferably the wall (e.g., 34) of the container (e.g., 30) is cylindrical and of substantially constant inner diameter $D_c$ along its longitudinal axis (not indicated). In some embodiments, the container (e.g., 30) is suitable for mixing a construction material. Examples of such construction containers are buckets and framing for holding recently poured concrete during curing, drying, or both. In some embodiments, size of the enclosed volumetric space (e.g., 36) of the container (e.g., 30) is a volume suitable for manufacturing scale operations such as, for example, where the container (e.g., 30) is a 100 gallon (380 liter) to 10,000 gallon (38,000 liter) mixing or reactor vessel. In some embodiments, size of the enclosed volumetric space (e.g., 36) of the container (e.g., 30) is a volume suitable for pilot plant scale operations such as, for example, where the container (e.g., 30) is from 2 gallon (7.6 liter) to less than 100 gallon (380 liter) mixing or reactor vessel. In some embodiments, size of the enclosed volumetric space (e.g., 36) of the container (e.g., 30) is a volume suitable for laboratory scale operations. Examples of types of suitable laboratory scale containers (e.g., 30) are vials, test tubes, mixing tubes, beakers, bottles, and 96-well plates. Volumes of the suitable laboratory containers (e.g., enclosed volumetric space 36 of containers 30) can be any volume up to about 10,000 milliliters (mL). Preferably, the volumes are 1000 mL or less, more preferably 50 mL or less, still more preferably about 20 mL or less, and at least about 0.2 mL. In some embodiments, containers having flowable materials and a magnetic stir element, if any, disposed therein also have headspaces that comprises at least 10 percent, more preferably at least 15 percent, of enclosed volumetric space (e.g., 36) of the containers (e.g., 30).

In some embodiments, the enclosed volumetric space (e.g., 36) of the container (e.g., 30) is in fluid communication with an exterior (not indicated) to the container (e.g., 30) via the aperture (e.g., 38) of the top portion (not indicated) of the container (e.g., 30). In some embodiments (especially those employing an aforementioned horizontal orientation or inverse vertical orientation of the rotatable mixing device), the rotatable mixing device (e.g., 10 and 12) further comprises the drivable connecting element (e.g., 22) and the dynamic mixing apparatus (e.g., 70) further comprises a sealing means (not shown), the sealing means being in sealing operative contact with a portion (not indicated) of the container (30) proximal to the aperture thereof and in low-friction (i.e., allowing rotation) sealing contact with the drivable connecting element (e.g., 22) of the rotatable mixing device (e.g., 10 and 12) so as to seal the container against leakage of the two or more flowable materials. Examples of the sealing means are a silicone lubricant, a stirrer bearing, a lubricated rubber septum, a polytetrafluoroethylene sleeve, and a combination of two or more thereof.

In some embodiments, the dynamic mixing apparatus (e.g., 10 and 12) further comprises a container holder (not shown) disposed for holding the container (e.g., 30). When the invention contemplates employing a container holder, preferably the container holder is capable of holding from 1 to 1000 containers, more preferably from 4 to 96 containers. The invention contemplates embodiments wherein the dynamic mixing apparatus (e.g., 10 and 12) has and the method of the fourth embodiment simultaneously employs more than one container holder (e.g., four 96-well plates giving a total of 384 containers). An example of a container holder is rectangular block (not shown) defining a plurality of apertures, each aperture of the block being dimensioned for holding one container (e.g., 30). The block may further comprise a rectangular frame (not shown) on which rectangular block could securely sit, a frame having spaced-apart opposing rails against which front and rear faces of rectangular block could be urged.

Preferably, method of the fourth embodiment employs the high throughput workflow system of the third embodiment. More preferably, high throughput workflow system is capable of mixing according to a method of the fourth embodiment two or more flowable materials in each of the two or more (i.e., plurality) of containers (e.g., 30) of two or more dynamic mixing apparatuses (e.g., 70), wherein the flowable materials in different ones of the containers may be the same or different. Preferably, direction of rotation of the rotatable mixing devices (e.g., 10) is different between adjacent ones, and thus the same in every other one, of the two or more dynamic mixing apparatuses (e.g., 70) of the high throughput workflow system.

The term "workflow" means an integrated process comprising steps of experimental design, mixing two or more materials together to give mixtures, independently analyzing the mixtures to determine one or more characteristics or properties thereof (e.g., degree of mixing), and collecting data from the resulting mixture analyses. In this context, the term "high throughput workflow" means the steps of the workflow are integrated and time-compressed such that an overall time to execute the integrated process of the high throughput workflow is from 2.0 times or more (e.g., 10, 50 or 100 times or more) faster than an overall time to execute a corresponding process of a standard non-high throughput workflow (e.g., any corresponding prior art process). Preferably, the high throughput workflow system of the third embodiment further comprises a material dispensing robot for dispensing flowable materials, especially liquids, into the plurality of containers.

The invention contemplates some embodiments will further comprise or employ a means (not shown) of varying the pressure environment, a means (not shown) of heating or cooling the flowable materials, or both in the containers (e.g., 30). Examples of such means of heating are infrared radiation, microwave radiation, hot air environment, a heating bath (e.g., warm water or mineral oil bath), and, preferably, employing a container holder having a thermostatable heating element (e.g., electric heating element) disposed therein. Examples of such means for cooling are cold air environment, a cooling bath (an ice/water bath, and a container holder (not shown) having a thermostatable cooling element (e.g., chilled glycol line). A preferred temperature range for carrying out the method of the fourth embodiment is from 0° C. to 120° C. Ambient temperature (e.g., 20° C.) is preferred. When flowable materials are employed that are difficult to move or mix at ambient temperature (e.g., liquids having viscosities above 100,000 cP and preferably less than 500,000 cP, or flowable materials having densities differing by a factor of 1.5 or more), the flowable materials can be heated as described above to lower their effective viscosities.

The method of the fourth embodiment contemplates procedures wherein additional flowable materials are added during performance of the method.

The rotatable mixing device (e.g., 10 and 12) and dynamic mixing apparatus (e.g., 70) of the present invention can be constructed from one or more materials known for use in the art. Examples of the materials are metals (e.g., titanium), metal alloys (e.g., steel, stainless steel, and HASTELLOY® (Haynes International, Inc.) alloys), glass (e.g., a borosilicate glass), ceramic, plastic (e.g., polypropylene and polytetrafluoroethylene), reinforced plastic (e.g., fiberglass reinforced plastic), and combinations thereof. Preferred construction materials for rotatable mixing devices are metals and metal alloys such as, for example, number 316 stainless steel or, where used in high throughput workflow systems, an organic polymer such as, for example, a poly(acrylic acid) or polytetrafluoroethylene.

The present invention contemplates employing any flowable material. The term "flowable material" means a particulate solid, liquid, or gas. Preferably, the flowable materials comprise a liquid flowable material and a solid flowable material, two or more different liquid flowable materials, or a liquid flowable material and a gaseous flowable material. The term "particulate solid" means a substance having a definite shape and volume and includes substances having amorphous, crystalline, or semicrystalline form and shapes such as, for example, flakes, plates, spheres, ovoids, square-shapes, needles, and the like. Preferred particulate solids are opacifiers or fillers (e.g., talc, silica dioxide, titanium dioxide, inorganic clays, organoclays, carbon blacks, zirconium oxide, and aluminum oxide. The term "liquid" includes neat substances and solutions of one or more solutes in one or more solvents. Preferred liquids are high viscosity liquids at 20° C. such as, for example, silicone oils, silicone greases, hydrocarbon oils and greases, solutions of hydrocarbon waxes in solvents, polymer latex dispersions in water, polymers dissolved in organic solvents, water soluble polymers (e.g., polyethylene oxide) dissolved in water, natural gums such as guar or xanthic gum; and low viscosity liquids at 20° C. such as, for example, water, organic solvents having boiling points less than 200° C. (e.g., alcohols, glycols, ketones, chlorinated solvents), amides such as dimethylformamide and N-methylpyrrolidine, ethers and cyclic ethers such as tetrahydrofuran, and aromatic solvents such as toluene and xylenes. Preferred gases are carbon dioxide and blowing agents such as fluorotrichloromethane (CFC 11), 1,1,1,3,3-pentafluoropropane, 1,1,2,2,3,3-hexafluoropropane, 1,1,1,2,3-pentafluoropropane, 1,1,1,3,3-pentafluorobutane, cyclopentene, normal-pentane, 1,1,2,2-tetrafluoroethane, 1,1,1-trifluoroethane, 1,1-difluoroethane, and 1,1-dichlorofluoroethane.

When two or more flowable materials are combined and mixed in a container according to the present invention, the flowable materials in a same container (e.g., 30) are different from each other. By "different," what is meant is the flowable materials vary from each other by, for example, composition, phase (i.e., solid, liquid, or gas), density, purity, viscosity, or a combination of two or more thereof. Examples of combinations of two or more flowable materials are:

a combination of a polyglycol (e.g., a polyether-based or polyester-based glycol) and one or more of a liquid or a solid additive such as a rust inhibitor, antioxidant, biocide, and passivator;

a combination of water and one or more of a liquid or solid additive such as primary surfactant (e.g., a fatty acid or sulfonic acid), a non-ionic surfactant, a foaming agent (e.g., alkanolamides), rheology modifier (e.g., methylcellulose), conditioning agent (e.g., silicones and salts), preservative (e.g., antimicrobial), or a modifier (e.g., acid, base, opacifier, or scent);

a combination of two or more of a solid (e.g., pigment, inorganic clay, or tint) and a colloidal solution of latex in water, additive dissolved in a solvent wherein the additive is a surfactant, film forming agent, antifoaming agent, antimicrobial, dispersant, neutralizer, or rheology modifier;

a combination of two or more of a liquid (epoxy prepolymer) and hardener (e.g., bisphenol A) dissolved in a solvent (e.g., acetone or toluene), and an additive (filler, opacifier, toughener, rheology modifier, accelerator (e.g., curing agent), adhesion promoter, colorant, and anti-oxidant; and.

a combination of two or more of a polyurethane pre-polymer made from an isocyanate and glycol, amine catalyst, dispersant, blowing agent, surfactant, and plasticizer.

As used herein, the term "viscosity" means dynamic viscosity at 20° C. as measured using a Brookfield CAP-2000 cone and plate viscometer (Brookfield Engineering Laboratories, Inc., Middleboro, Mass., USA) and the immediately following test method. Test method: If necessary, warm up the viscometer for about 30 minutes. Calibrate the viscometer using a viscosity standard by conventional means. Set the viscometer's temperature control, dispense a test sample onto the plate, and affix an appropriate cone (as would be known) thereto such that the affixed test sample completely covers a face of the cone and extends about 1 millimeter beyond the cone's edge. Wait about from 1 minute to 3 minutes to allow the affixed test sample to reach temperature equilibrium, then execute a viscosity measurement therewith the cone being rotated at an appropriate rate for the cone (as would be known) and record the resulting outputted viscosity value for the test sample.

In some embodiments, the method of the fourth embodiment employs at least one flowable material that is a medium or high viscosity liquid or at least two flowable materials that are liquids, wherein at least one of the flowable materials is a low viscosity liquid (i.e., a liquid having a dynamic viscosity from 0.3 cP (0.0003 Pascal-seconds (Pa-s) to less than 200 cP (0.2 Pa-s) at 20° C.) and at least another one of the flowable materials is a medium viscosity liquid (i.e., a liquid having a dynamic viscosity from 200 cP (0.2 Pa-s) to less than 10,000 cP (10 Pa-s) at 20° C.) or, preferably, a high viscosity liquid (i.e., a liquid having a dynamic viscosity from 10,000 cP to 200,000 cP (10 Pa-s to 200 Pa-s) at 20° C.). In some embodiments, at least one of the at least two flowable materials is a flowable liquid and at least another one of the at least two flowable materials is a flowable gas (characterized at 20° C.), wherein the flowable gas has a dynamic viscosity of from 0.009 cP (0.000009 Pa-s) to less than 0.00003 Pa-s at 20° C. and the flowable liquid has a dynamic viscosity of from 0.4 cP (0.0004 Pa-s) to 200,000 cP (200 Pa-s), the dynamic viscosities being measured at 20 degrees Celsius using a Brookfield CAP-2000 cone and plate viscometer; and the method giving the approximately uniform mixture thereof in less than 10 minutes.

Materials

General Considerations.

Flowable materials used: Fluids 1 and 2

Fluid 1:2 mL of water mixed with 0.1 mL blue water soluble food color together forming a fluid of viscosity of about 0.001 Pa-s (1 cP)

Fluid 2:20 mL of Corn syrup of viscosity of about 10 Pa-s (10,000 cP) Calculation of percent uniformity of mixing (i.e., mixedness) of flowable materials mixed in a glass vial As corn syrup (Fluid 2) is very light in color, and water containing a dye (Fluid 1) having a deep blue shade, a sharp color contrast exists between the two fluids. After creating a digital video recording of the mixing experiment, images from the source video recording were extracted at appropriate (e.g., regular, e.g., every 10 seconds) time intervals. In each extracted image, the cross-sectional area of the glass vial is selected for subsequent analysis using ImageJ (Version 1.42 k), open source image editing and analysis software. ImageJ software includes a utility called Threshold that allows the user to quantify the relative color contrast, and declare each pixel inside the selected area of the image to be either "blue" or "not blue". Using a macro, ImageJ software helps determine fractional area of both blue and not blue regions. During the experiment, dyed water (Fluid 1) gets partially mixed into the corn syrup (Fluid 2) creating regions of light blue which becomes apparent in the extracted images. To account for portions of the extracted images where such partial mixing is recorded, a reference point for "blue" is established using a final image of a fully mixed solution (i.e., a uniform mixture). Regions exhibiting a color contrast at least as bright as the fully mixed fluid are considered "blue", while regions with less contrast than the fully mixed fluid are considered "not blue". Each image is normalized to correct for empty space associated with mixing vortices that form during the experiment

EXAMPLE(S) OF THE PRESENT INVENTION

Non-limiting examples of the present invention are described below. In some embodiments, the present invention is as described in any one of the examples.

Example 1

Mixing of a Low Viscosity Flowable Material (Fluid 1) with a High Viscosity Material (Fluid 2) to Prepare an Approximately Uniform Mixture Thereof Add 20 mL of Fluid 2 and 2 mL of Fluid 1 in a 40 mL glass vial (e.g., 30; for example a vial that has 1 inch (2.54 centimeter (cm)) diameter and 3.15 inch (8.00 cm) length and a flat bottom) to give an incompletely mixed (essentially unmixed) test sample therein, the vial having a headspace above the incompletely mixed sample (e.g., space above hypothetical fill line 35 in container 30 as described previously for FIG. 2). Repeat so as to prepare a duplicate test sample. Fluid 1 is less dense and, thus, floats at the top above Fluid 2. Submerge a portion of a different rotatable mixing device (e.g., 10), each having 2 helical mixing elements (e.g., 50 and 50A), in the incompletely mixed sample so that both helical mixing elements are submerged therein. Each rotatable mixing device is of a general configuration as shown in FIG. 1A and dimensioned with a diameter $D_e$ of 7/16 inch (1.1 cm) and a length $L_e$ of ¾ inch (1.9 cm). The helical mixing elements have an angle of twist ($T_e$) of about 180 degrees. Space the leading edge of the leading helical mixing element (i.e., bottom helical mixing element in FIG. 1A) of the rotatable mixing device so as to be a distance $S_a$ from the bottom of the glass vial of about 0.2 inch (0.51 cm). Mix Fluid 1 and Fluid 2 therein according to the method of the embodiment by rotating the rotatable mixing device at 600 revolutions per minute (rpm). Monitor the mixing of the Fluids visually as well as by videotaping using a DCR-VX2000 NTSC HANDYCAM™ digital video camera and recorder (Sony Corporation, Tokyo, Japan) so as to obtain recorded video images as a function of time. Results of the mixing are shown below in Table 1.

TABLE 1 percent uniformity of mixing of Fluid 1 and Fluid 2.

| Mixing Time (seconds) | % Fluid 2 | % Fluid 1 | % uniformity of mixing |
|---|---|---|---|
| 0* | 95.9462 | 4.0538 | 4.1926 |
| 2 | 91.5603 | 8.4397 | 8.7287 |
| 4 | 87.421 | 12.5790 | 13.0098 |
| 6 | 85.5736 | 14.4264 | 14.9204 |
| 8 | 84.2818 | 15.7182 | 16.2565 |
| 10 | 84.8595 | 15.1405 | 15.6590 |
| 12 | 71.6596 | 28.3404 | 29.3109 |
| 14 | 31.304 | 68.6960 | 71.0484 |
| 16 | 14.922 | 85.0780 | 87.9914 |
| 18 | 9.1997 | 90.8003 | 93.9096 |
| 20 | 6.2846 | 93.7154 | 96.9246 |
| 22 | 6.3919 | 93.6081 | 96.8136 |
| 24 | 3.8722 | 96.1278 | 99.4196 |
| 84 | 3.311 | 96.6890 | 100.0000 |

*For the incompletely mixed test sample

Analysis of the results shown in Table 2 indicates that after just 24 seconds, the rotatable mixing device shows greater than 99% uniformity of mixing. The percent uniformity of mixing reaches 100% (complete mixing) in 84 seconds.

The rotatable mixing device of the first embodiment, dynamic mixing apparatus of the second embodiment, system of the third embodiment, and method of the fourth embodiment are useful in any procedure, process, or method that could benefit from mixing flowable material. The embodiments are especially useful for mixing flowable materials wherein at least one flowable material is a liquid that is characterizable as having a medium or high viscosity liquid at 20° C. (e.g., a high viscosity solution for crystallization of a solute therefrom) and at least one flowable material is a liquid or gas that is characterizable as having a low viscosity. Thus, the embodiments are useful in the aforementioned applications.

While the invention has been described above according to its preferred embodiments, it can be modified within the spirit and scope of this disclosure. This application is therefore intended to cover any variations, uses, or adaptations of the instant invention using the general principles disclosed herein. Further, the instant application is intended to cover such departures from the present disclosure as come within the known or customary practice in the art to which this invention pertains and which fall within the limits of the following claims.

What is claimed is:

1. A rotatable mixing device comprising a leading helical mixing element; a trailing helical mixing element; a number N intermediate helical mixing elements, where N is an integer of 0 or greater; and a number X means for connecting (connecting means), where X equals 1 plus N; the helical mixing elements having a twisted ribbon-shape and the same direction of twist (i.e., handedness); the rotatable mixing device being configured in such a way that the leading, intermediate, and trailing helical mixing elements are axially aligned with and in sequential operative connection to each other, each operative connection between adjacent helical mixing elements independently comprising one of the connecting means; each helical mixing element independently being characterizable as having spaced-apart leading and trailing edges; a longitudinal axis; a length ($L_e$) along its longitudinal axis; an angle of twist ($T_e$) of from 90 degrees) (°) to 360° about its longitudinal axis; a diameter ($D_e$) perpendicular to its longitudinal axis; and being dimensioned so as to establish a configuration of the helical mixing element characterizable by a mathematical relationship between each $L_e$ and $D_e$ of $D_e \leqq L_e \leqq 2D_e$; adjacent helical mixing elements and the connecting means through which they are connected are configured in such a way so as to dispose the leading edge of one of the adjacent helical mixing elements within a separation distance ($S_a$) of and at an offset angle ($\alpha_a$) to the trailing edge of the other of the adjacent helical mixing elements so as to independently establish relative spacing and orientation between the adjacent helical mixing elements characterizable by a mathematical relationship between $S_a$ and each of their $L_e$ of $0L_e \leqq S_a \leqq L_e$ and a value for $\alpha_a$ of from 0° to 90°, respectively.

2. The rotatable mixing device as in claim 1, $\alpha_a$ being $75° \leqq \alpha_a \leqq 90°$.

3. The rotatable mixing device as in claim 1, $S_a$ being $0L_e$.

4. The rotatable mixing device as in claim 1, $S_a$ being $0L_e < S_a \leqq L_e$.

5. A dynamic mixing apparatus comprising the rotatable mixing device as in claim 1 and a container; the container having top and bottom portions and a wall portion, the top portion defining an aperture, the wall portion being disposed between the top and bottom portions so as to space apart the top and bottom portions and define an enclosed volumetric space within the container, the container having a longitudinal axis between the aperture of the top portion and the bottom portion; at least the helical mixing elements of the rotatable mixing device being disposed within the enclosed volumetric space of the container.

6. The dynamic mixing apparatus as in claim 5, the container being characterizable as having an inner diameter ($D_c$) perpendicular to its longitudinal axis and within the enclosed volumetric space of the container; the dynamic mixing apparatus being dimensioned in such a way so as to establish a mathematical relationship between $D_c$ and each $D_e$ of $0.10D_c \leqq D_e \leqq 0.70D_c$.

7. The dynamic mixing apparatus as in claim 5, all of the helical mixing elements of the rotatable mixing device being disposed within the enclosed volumetric space of the container in such a way that the rotatable mixing device and the container are approximately axially aligned with each other and the leading edge of the leading helical mixing element is spaced-apart from the bottom portion of the container by a distance ($\delta_b$) so as to establish a mathematical relationship between $\delta_b$ and $L_e$ of the leading helical mixing element of $0L_e < \delta b \leqq L_e$.

8. A high throughput workflow system comprising at least two dynamic mixing apparatuses as in claim 5.

9. A dynamic mixing method of mixing together two or more flowable materials, the two or more flowable materials being disposed in the enclosed volumetric space of the container of the dynamic mixing apparatus as in claim 5, the two or more flowable materials being in a form of an incompletely mixed composition thereof, the incompletely mixed composition comprising a total volume that is less than the enclosed volumetric space of the container and sufficient so as to at least mostly submerge at least the leading one of the helical mixing elements of the rotatable mixing device, the method comprising independently rotating the rotatable mixing device of the dynamic mixing apparatus at a sufficient speed and in a direction appropriate for the handedness of the helical mixing elements so as to establish a simultaneous downward-directed flow of the two or more flowable materials adjacent the rotatable mixing device and an upward-directed flow of the two or more flowable materials spaced apart from the rotatable mixing device and adjacent the downward-directed flow, the downward-directed and upward-directed flows being essentially parallel to the longitudinal axes of the rotatable mixing device and container, thereby mixing the two or more flowable materials together to give an approximately uniform mixture thereof.

10. The dynamic mixing method as in claim 9, the incompletely mixed composition having a top surface, all of the helical mixing elements being submerged in the incompletely mixed composition.

11. The dynamic mixing method as in claim 10, the top surface of the incompletely mixed composition being spaced apart from the trailing edge of the trailing helical mixing element by a distance ($\delta_s$) so as to establish a mathematical relationship between $\delta_s$ and $L_e$ of the trailing helical mixing element of $0L_{et} \leqq \delta_s \leqq L_{et}$, where $L_{et}$ is the length $L_e$ of the trailing helical mixing element.

12. The dynamic mixing method as in claim 9, the method further employing at least one additional dynamic mixing apparatus, thereby employing a total of at least two dynamic mixing apparatuses, the two dynamic mixing apparatuses comprising a high throughput workflow system.

13. The dynamic mixing method as in any one of claim 9, each of the at least two flowable materials being independently characterizable as having a dynamic viscosity, the dynamic viscosity of one of the at least two flowable materials being from 0.0003 Pascal-seconds to less than 0.2 Pascal-seconds and the dynamic viscosity of another of the at least two flowable materials being from 10 Pascal-seconds to 200 Pascal-seconds, the dynamic viscosities being measured at 20 degrees Celsius using a Brookfield CAP-2000 cone and plate viscometer; and the method giving the approximately uniform mixture thereof in less than 10 minutes.

14. The dynamic mixing method as in claim 9, wherein at least one of the at least two flowable materials is a flowable liquid and at least another one of the at least two flowable materials is a flowable gas, wherein the flowable gas has a dynamic viscosity of from 0.000009 Pascal-seconds to less than 0.00003 Pascal-seconds at 20° C. and the flowable liquid has a dynamic viscosity of from 0.0004 Pascal-seconds to 200 Pascal-seconds, the dynamic viscosities being measured at 20 degrees Celsius using a Brookfield CAP-2000 cone and plate viscometer; and the method giving the approximately uniform mixture thereof in less than 10 minutes.

* * * * *